United States Patent [19]

Gentry et al.

[11] Patent Number: 4,790,167

[45] Date of Patent: Dec. 13, 1988

[54] EXTRUSION RUN-OUT TABLE

[75] Inventors: Charles B. Gentry, Belmont; Robert M. Scanlon, Sand Lake; John C. Bugai, Comstock Park, all of Mich.

[73] Assignee: Granco-Clark, Inc., Mich.

[21] Appl. No.: 65,838

[22] Filed: Jun. 23, 1987

[51] Int. Cl.[4] ..... B21C 29/00

[52] U.S. Cl. ..... 72/257; 72/364

[58] Field of Search ..... 72/255, 256, 257, 364, 72/426

[56] References Cited

U.S. PATENT DOCUMENTS

| | | | |
|---|---|---|---|
| 1,393,144 | 10/1921 | Laskey . | |
| 1,841,714 | 1/1932 | Cone . | |
| 2,339,979 | 1/1944 | Clarke . | |
| 2,447,415 | 8/1948 | Lyon . | |
| 2,452,607 | 11/1948 | Slaughter . | |
| 2,453,400 | 11/1948 | Barnett et al. . | |
| 2,461,630 | 2/1949 | Cozzo . | |
| 2,767,432 | 10/1956 | Mooney . | |
| 2,902,271 | 9/1959 | Colombo . | |
| 2,914,170 | 11/1959 | Kent | 72/257 |
| 3,007,256 | 11/1961 | Rouy . | |
| 3,549,737 | 11/1967 | Schulze . | |
| 3,589,694 | 6/1971 | Gelling . | |
| 3,618,169 | 11/1971 | Coast . | |
| 3,665,863 | 5/1972 | Patin . | |
| 3,739,619 | 6/1973 | Follrath et al. | 72/257 |
| 4,294,878 | 10/1981 | Cunningham et al. . | |
| 4,323,533 | 4/1982 | Bramhall . | |
| 4,418,482 | 12/1983 | Aidin et al. . | |
| 4,453,321 | 6/1984 | McDonald et al. | 72/257 |
| 4,465,447 | 8/1984 | Cheigh et al. . | |
| 4,632,752 | 12/1986 | Hunke . | |
| 4,636,341 | 1/1987 | Murley . | |

*Primary Examiner*—Lowell A. Larson

*Attorney, Agent, or Firm*—Varnum, Riddering, Schmidt & Howlett

[57] ABSTRACT

An extrusion run-out table for aluminum extrusions and the like has an extrusion support table for supporting extruded profiles as they are extruded from an extrusion press along an extrusion path and a conveyor for moving the extruded shapes from the extrusion support table to a cooling area and to a further processing area. The extrusion support table includes a set of elongated heat-resistant bars mounted perpendicular to the extrusion path, with the bars extending laterally of the extrusion path into the cooling area a distance sufficient to position one or more of the extended shapes in laterally spaced relationship to the extrusion path. The extruded shapes are cooled through an air manifold above the extrusion path and through a series of air jet nozzles which project cooling air against the extruded shapes as they are extruded. The air jet nozzles are tailored to direct the quantity and direction of the cooling fluid against the shapes so as to minimize distortion of the shapes due to differential cooling. A special baffle arrangement is provided beneath one side of the support table and beneath an opposite side of the cooling area to direct the downwardly-moving cooling air laterally and then upwardly through the cooling area.

19 Claims, 3 Drawing Sheets

EXTRUSION RUN-OUT TABLE

BACKGROUND OF THE INVENTION

1. Field of the Invention

This invention relates to extrusion of shapes of metal, for example, and cooling such shapes as they are being extruded and subsequent to extrusion.

2. State of the Prior Art

Presently, aluminum extrusions are made by expressing profiles or shapes of aluminum through a die and cutting the shapes to length. More recently, use has been made of extrusion pullers for pulling the extruded shapes as the shapes are expressed from the extrusion press or die. Subsequent to extrusion, the shapes are moved to a cooling area so that additional shapes can be extruded. The cooled shapes are then stretched to straighten the shapes and are then cut to length. In order to hasten the cycle time, the shapes are typically cooled with air as they are extruded from the die. Further, as the shapes are passed through a cooling area and to the stretcher, additional air is blown onto the shapes, usually from below the shapes with large fans. These fans are typically very noisy and consume significant amounts of electricity. The air blown onto the shapes along the extrusion path is directed downwardly from a large manifold. It is known to provide a large deflector at a 45° angle to the horizontal adjacent the bottom of the slat support table in an effort to direct at least a portion of the downwardly directed air upwardly against the profiles in the cooling area. Because of the limited amount of direction of the air to the deflector and because of escape of air beneath the other side of the slat conveyor, this deflector has been of marginal value.

The extruded profiles are drawn along a series of slats which include heat-resistant bars, typically of carbon. After extrusion, the bars are immediately moved onto heat-resistant belts and are indexed through sets of belts into and through the cooling area. These belts are quite expensive and are frequently damaged by the heat of the aluminum extrusions. It is therefore desireable to slow down the cycle time to accommodate the cooling of the profiles so that the belts are not damaged by the extruded proviles.

Very complex shapes are frequently extruded in aluminum. These shapes include areas which are thicker than other areas. This differential thickness in cross-section results in differential cooling rates of the extruded profiles. Frequently, these complex shapes warp during cooling due to differential cooling of the shapes. Stretching of the profiles is not always effective to remove all of the warpage.

SUMMARY OF THE INVENTION

According to the invention, there is provided an extrusion run-out table for aluminum extrusions and the like wherein conveyor belts which transfer the hot extrusions to the cooling area are prevented from overheating while the extruded shapes are cooled very efficiently and very effectively to minimize distortion due to differential cooling. An extrusion support table provides support for extruded profiles as they are extruded from an extrusion press along an extrusion path. A conveyor means moves the extruded shapes from the extrusion support table to a cooling area and to a further processing area. The extrusion support table includes a set of elongated heat-resistant bars mounted perpendicular to the extrusion path. The elongated heat-resistant bars have, according to the invention, a length which extends laterally of the extrusion paths into the cooling area and a distance sufficient to position at least one, and preferably several, of the extruded shapes in laterally spaced-apart relationship to the extrusion path to permit additional shapes to be extruded along the extrusion path while the extruded shape is or the extruded shapes are cooling in the cooling area. The conveyor means indexes each successive extruded shape in the cooling area on the elongated bars subsequent to completion of the extrusion.

Means are provided to cool the extruded shapes in the cooling area. To this end, an air manifold is mounted above the extrusion path and is adapted to direct air downwardly along the extrusion path. A first baffle means is mounted beneath the extrusion support table, preferably on one side thereof, and is adapted to direct air from the manifold laterally toward the cooling area. A second baffle means is mounted beneath the cooling area, preferably on a side of the cooling area distal from the first baffle means and aligned with the first baffle means to deflect air from the first baffle means upwardly onto the extruded shapes in the cooling area.

In a preferred embodiment of the invention, the cooling means includes means to tailor the cooling to the shape of the extruded profiles as the profiles are extruded along the extrusion path. This cooling means comprises a plurality of nozzles spaced along the extrusion path and means to supply cooling fluid to the nozzles.

Also, in accordance with the invention, there is provided a method for extruding aluminum profiles and the like wherein the profiles are extruded along an extrusion path and cooling fluid is applied to the extruded profiles as they pass along the extrusion path. The amount and direction of the cooling fluid applied to the profiles are tailored so as to provide more uniform cooling of the profile along an entire cross-sectional shape thereof.

BRIEF DESCRIPTION OF THE DRAWINGS

The invention will now be described with reference to the accompanying drawings wherein.

DETAILED DESCRIPTION OF THE DRAWINGS

Figure 1:
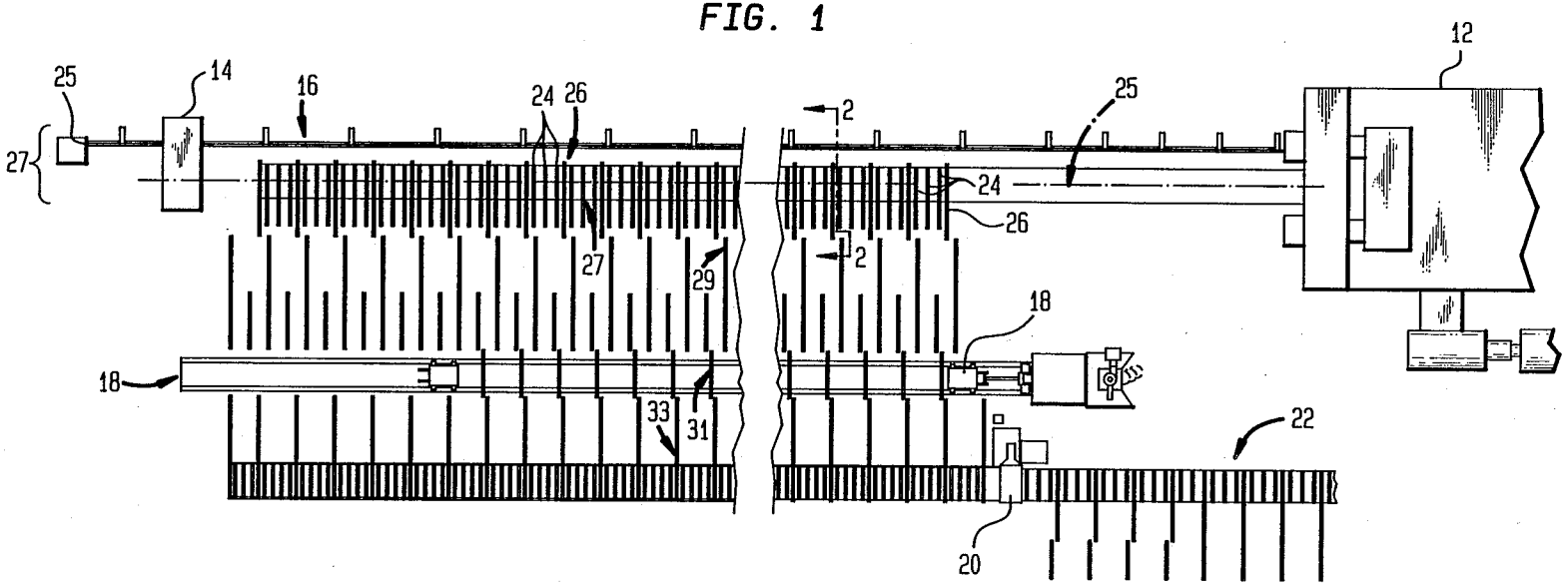
FIG. 1 is a plan view of an extrusion run-out table according to the invention.

Referring to FIG. 1, there is shown an extrusion run-out table 10, an extrusion press 12, an extrusion puller 14 which traverses an extrusion path 25 along the extrusion rail 16 and a set of slats 24 perpendicular to the extrusion path 25. A stretcher 18, a saw 20 and a stacker 22 are positioned in juxtaposed relationship to the extrusion press 12. The stretcher 18, the saw 20 and the stacker 22 are conventional and need no further description. As extruded shapes 23 exit the extrusion press 12, the extrusion puller 14 pulls the shapes 23 along the extrusion rail 16 and lays the hot extruded shapes on the slats 24. The slats 24 are composed of a heat-resistant, carbon-like material which can withstand the heat of the extruded profiles. The slats 24 extend laterally for a considerable distance from the extrusion path 25 in order to provide a cooling area 27 for the hot profiles and are stationary relative to the moving extrusion profiles.

Running parallel to, and interspaced between the slats 24, are a first set of conveyor belts 26. The illustrated embodiment in FIG. 1 incorporates three equally spaced slats 24 between each successive conveyor belt 26. A second set of conveyor belts 29 is positioned along a line parallel to and adjacent to the first set of conveyor belts 26 but positioned to receive work from the conveyor belts 26. Likewise, a third set of conveyor belts 31 is positioned in a receiving relationship to the conveyor belts 29 and a fourth set of conveyor belts 33 is positioned in receiving relationship to the third set of conveyor belts 31. The conveyor belts 26, 29, 31 and 33 are conventional belt conveyors and are driven in conventional fashion by conventional motors, pulleys and belts. Conveyor belts 26 advance the cooling profiles on the slats 24 from the extrusion path 25 to the cooling area 27, then to the second set of conveyor belts 29, then to the third set of conveyor belts 31 and finally to the fourth set of conveyor belts 33. The profiles are stretched or straightened at the stretcher 18 and are cut to length at the saw 20.

Figure 2:
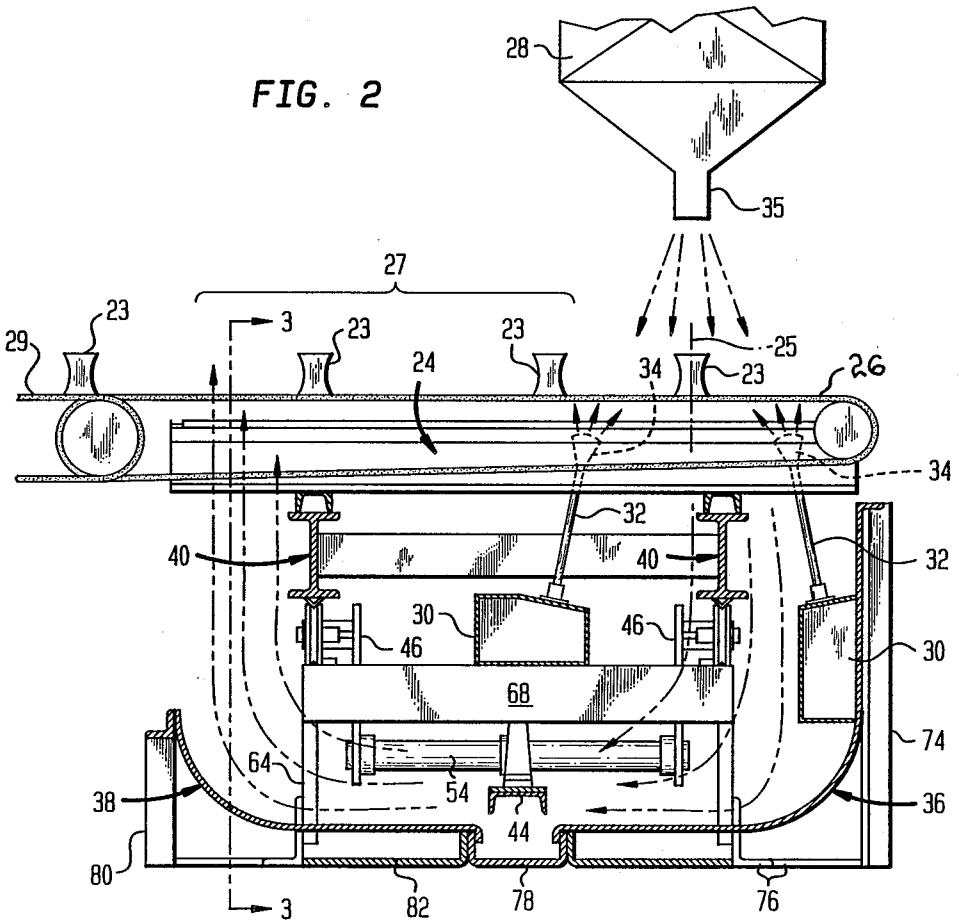
FIG. 2 is a partial sectional view taken along lines 2—2 of FIG. 1.

Referring now to FIG. 2, an air manifold 28 is mounted directly over the extrusion path 25 and extends along the length thereof to apply a downwardly directed stream of cooling air over the length of the extruded articles. To this end, the manifold has an elongated slot opening 35. The cooling process is also aided by upwardly directed air from the underside of the cooling articles by a lower cooling manifold 30 having upwardly directed pipes 32 and nozzles 34 at the upper ends of the pipes 32. Unlike the upper cooling manifold 28 which applies the air along the length of the extruded shapes 23 through an elongated slat, cooling air exits the lower cooling manifold 30 through pipes 32 and attached air jet nozzles 34. These air jet nozzles 34 direct the cooling air upwardly against the extruded shapes 23 in order to effect a more even cooling operation. The flow of air from each of these manifolds can be tailored to the shape of the extruded profiles so that the profiles have a more even cooling rate. Thus, more air is directed against thicker portions of the work than against thinner portions of the work. The controlled cooling will help reduce warpage of the work due to residual stresses resulting from differential cooling.

Air directed downwardly from the upper cooling manifold 28 is essentially recycled by the use of deflectors below the slats. A first deflector 36 directs the air laterally beneath the run-out table and the second deflector 38 directs the air upwardly against the extruded articles in the cooling area 27 of the run-out table, as shown by the arrows in FIG. 2. The first deflector 36 is positioned at one edge of the run-out table and outside of the area necessary for the lift equipment which will be described later. The first deflector 36 is supported by a vertical member 74 and a horizontal member 76. Thus, the first baffle 36 can extend the entire length of the run-out table to deflect the cooling air laterally therealong. In like manner, the second deflector 38 is outside of the area necessary for the lift equipment and can also extend along the entire length of the run-out table 10. The second deflector 38 is supported by a vertical member 80 and a horizontal member 82. Horizontal members 76 and 82 abut opposing, upwardly extending portions of a U-shaped member 78. Thus, continuous deflection of the cooling air into the cooling area can take place along the entire length of the run-out table.

Figure 3:
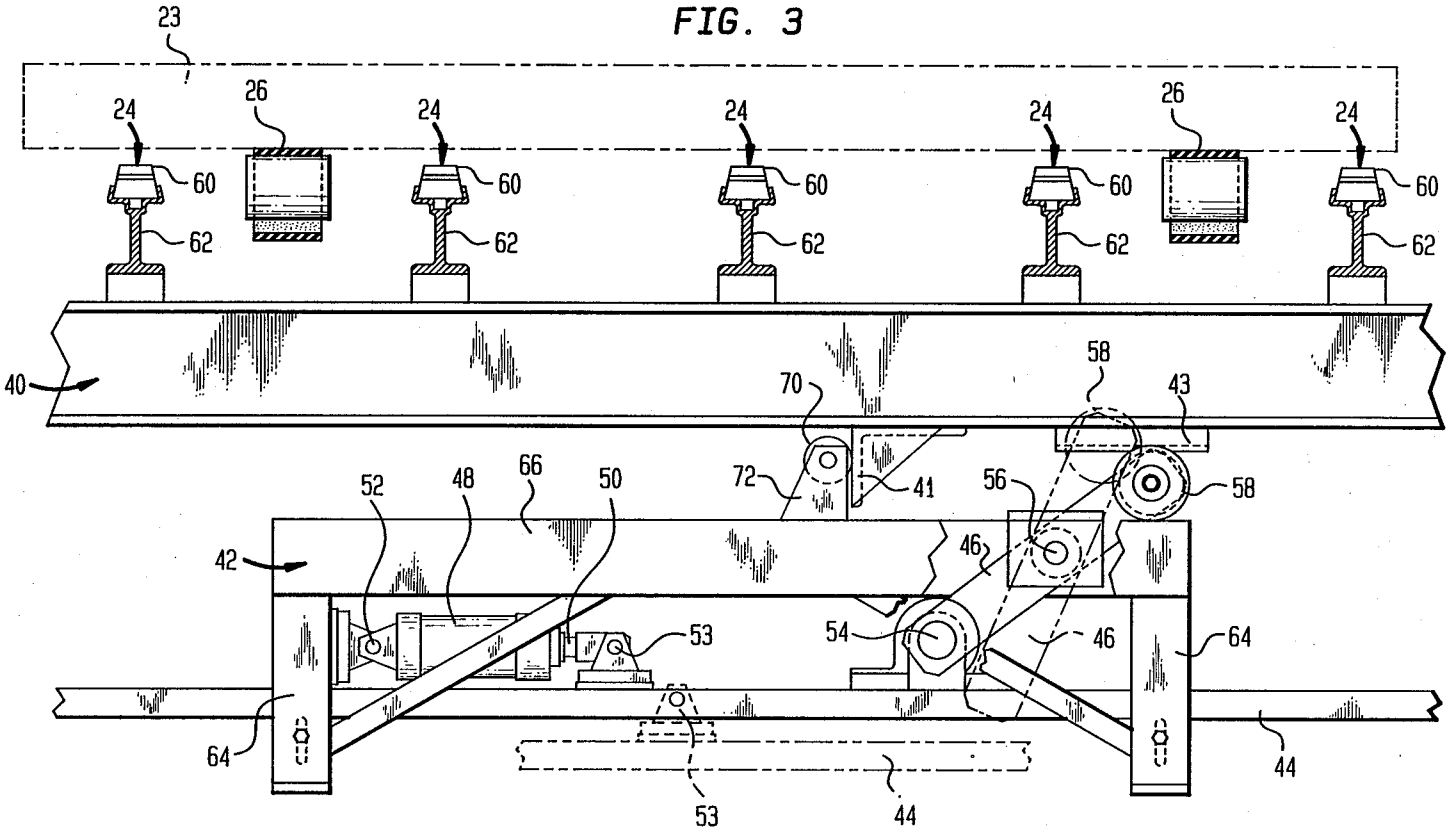
FIG. 3 is a partial sectional view taken along lines 3—3 of FIG. 2.

Due to the damaging effect of the high temperature of the extruded shapes 23 on the conveyor belts 26, the shapes 23 are cooled on the slats 24 and only contact the conveyor belt 26 for very short periods of time as the shapes 23 are advanced away from the extrusion path 25 toward the stretcher 18 and the saw 20. The advancing process is performed by vertically lowering the slats 24 until the extruded shapes 23 rest on the conveyor belts 26. The mechanism utilized in this particular embodiment for vertically raising and lowering the slats 24 is shown in FIGS. 2 and 3, to which reference is now made.

The slats 24 comprise a heat-resistant bar 60, preferably a carbon bar, mounted to an I-shaped support 62. Each slat is mounted on an elongated slat support beam 40. An angle bracket 41 and a rail 43 ar mounted to the underside of the support beam 40 in spaced relationship. A base 42 is formed by uprights 64, horizontal beams 66 and horizontal connecting beams 68, all welded or bolted together to form a rigid structure. A roller 70 is mounted to the upperside of the horizontal beam 66 in confronting relationship to the angle bracket 41. A crank arm 46 is pivotably mounted to the horizontal beam 66 through a pivot mounting 56. A roller 58 is mounted to one end of the crank arm 46 in registry with the rail 43. The other end of the crank arm 46 is pivotably mounted to a connector beam 44 through a pivot mounting 54. A fluid cylinder 48 is pivotably mounted at one end to the base 42 through a pivot mounting 52 and at the other end to the connector beam 44 through an extension rod 50 and pivot mounting 53.

The vertical raising and lowering of the slat support beam 40 is effected by the use of the fluid cylinder 48 having an extension rod 50. As the rod 50 is forced out of the cylinder 48, the connector beam 44 is forced to the right in FIG. 3. Because the connector beam 44 is mounted to the crank arm 46, the connector beam moves downwardly as it moves to the right. The crank arm 46 is also rotated in a counterclockwise direction as viewed in FIG. 3, and thereby raises the slat support beam 40 and thus the slats 24 at the same time. The slats 24 and slat support beam 40 are lowered merely by retracting the rod 50 back into the hydraulic fluid cylinder 48, to rotate the crank arm 46 in a clockwise direction back to the position illustrated in FIG. 3.

The invention provides a more economical means to cool extruded shapes while minimizing the damage to conventional transfer belts. Because the shapes can be cooled on the carbon-slat surfaces, cycle times can be enhanced without damage to the transfer belts. Further, the cooling can take place in a customized manner to minimize distortion due to differential cooling rates of complex shapes.

Reasonable variation and modification are possible within the scope of the foregoing disclosure and drawings without departing from the spirit of the invention which is defined in the appended claims.

The embodiments of the invention in which an exclusive property or privilege is claimed are defined as follows:

1. In an extrusion run-out table for aluminum extrusions and the like, the run-out table comprising:

an extrusion support table for supporting extruded profiles as they are extruded from an extrusion press along an extrusion path;

conveyor means for moving the extruded shapes from the extrusion support table to a cooling area and to a further processing area;

side extrusion support table including a set of elongated heat-resistant support means mounted perpendicular to the extrusion path;

means to impart relative vertical motion between said conveyor means and said set of support means to alternatively support said extruded shapes on said conveyor means or on said set of support means;

the improvement which comprises:

said elongated heat-resistant support means having a length which extends laterally of said extrusion path into said cooling area and a distance sufficient to position at least one of said extruded shapes in laterally spaced relationship to the extrusion path to permit additional shapes to be extruded along the extrusion path while said at least one extruded shape is cooling in said cooling area and on said support means; and said conveyor means and said means to impart vertical motion index each successive extruded shape into said cooling area on said elongated support means subsequent to completion of extrusion thereof.

2. An extrusion run-out table according to claim 1 wherein said heat-resistant support means are long enough to store several of said extruded shapes in juxtaposed relationship for cooling while an additional shape is being extruded.

3. An extrusion run-out table according to claim 2 and further comprising means to cool said extruded shapes in said cooling area.

4. An extrusion run-out table according to claim 3 wherein said cooling means comprises an air manifold mounted above the extrusion path and adapted to direct air downwardly along the extrusion path; first baffle means mounted beneath said extrusion support table and adapted to direct air from said manifold laterally toward said cooling area; and second baffle means mounted beneath said cooling area and aligned with said first baffle means to deflect air from said first baffle means upwardly onto said extruded shapes in said cooling area.

5. An extrusion run-out table according to claim 4 wherein said first baffle is positioned at one side of said extrusion support table and said second baffle is positioned at a side of said cooling area distal of said first baffle.

6. An extrusion run-out table according to claim 4 and further comprising means to cool said profiles as they are extruded along said extrusion path, including means to tailor the cooling of the shape of the extruded profiles for more uniform cooling of complex shapes.

7. An extrusion run-out table according to claim 6 wherein said means to tailor cooling comprises a plurality of nozzles spaced along the extrusion path, and means to supply cooling fluid to said nozzles.

8. An extrusion run-out table according to claim 1 and further comprising means to cool said profiles as they are extruded along said extrusion path including means to tailor the cooling of the shape of the extruded profiles for more uniform cooling of complex shapes.

9. An extrusion run-out table according to claim 8 wherein said means to tailor the cooling comprises a plurality of air jet nozzles spaced along the extrusion path.

10. An extrusion run-out table according to claim 1 wherein said conveyor means comprises a continuous belt.

11. In an extrusion run-out table for aluminum extrusions and the like, the extrusion run-out table comprising:

an extrusion support table for supporting extruded profiles as they are extruded from an extrusion press along an extrusion path;

conveyor means for moving the extruded shapes from the extrusion support table to a cooling area and to a further processing area;

the improvement which comprises:

cooling means comprising an air manifold mounted above the extrusion path and adapted to direct air downwardly along the extrusion path;

first baffle means mounted beneath said extrusion support table and adapted to direct air from said air manifold laterally toward said cooling area; and second baffles means mounted beneath said cooling area and aligned with said first baffle means to deflect air from said first baffle means upwardly onto said extruded shapes in said cooling area.

12. An extrusion run-out table according to claim 11 wherein said first baffle means are positioned at one side of said extrusion support table and said second baffle means are positioned at a side of said cooling area distal of said first baffle.

13. An extrusion run-out table according to claim 12 wherein said first and second baffle means extend substantially continuously along the length of said extrusion support table.

14. An extrusion run-out table according to claim 11 and wherein said cooling means include means to tailor the cooling to the shape of the extruded profiles for more uniform cooling of complex shapes.

15. An extrusion run-out table according to claim 14 wherein said means to tailor the cooling comprises a plurality of nozzles spaced along the extrusion path and means to supply cooling fluid to said nozzles.

16. An extrusion run-out table according to claim 11 and further comprising heat-resistant bars in said cooling area to support hot extruded shapes.

17. In an extrusion run-out table for aluminum extrusions and the like, said table comprising:

an extrusion support table for supporting extruded profiles as they are extruded from an extrusion press along an extrusion path;

conveyor means for moving the extruded shapes from the extrusion support table to a cooling area and to a further processing area;

means to cool said profiles as they are extruded along said extrusion path;

the improvement which comprises:

said cooling means including means to tailor the cooling to the shape of the extruded profiles for more uniform cooling of complex shapes.

18. An extrusion run-out table according to claim 17 wherein said means to tailor the cooling comprises a plurality of nozzles spaced along the extrusion path, and means to supply cooling fluid to said nozzles.

19. In a method for extruding aluminum profiles and the like wherein the profiles are extruded along an extrusion path and cooling fluid is applied to the extruded profiles as they pass along the extrusion path, the improvement which comprises tailoring the amount and direction of the cooling fluid onto the profiles so as to provide more uniform cooling of the profiles along an entire cross-sectional shape thereof.

* * * * *